United States Patent [19]

Merz et al.

[11] 4,267,037

[45] May 12, 1981

[54] APPARATUS FOR SEPARATING WASTE MATERIAL CONTAINED IN A HEAP

[75] Inventors: Karlheinz Merz, Waldshut-Tiengen; Roland Ulrich, Lauchringen, both of Fed. Rep. of Germany

[73] Assignee: Karl Merz Maschinenfabrik, Waldshut-Tiengen, Fed. Rep. of Germany

[21] Appl. No.: 103,698

[22] Filed: Dec. 14, 1979

[30] Foreign Application Priority Data

Dec. 15, 1978 [DE] Fed. Rep. of Germany ..... 2854177

[51] Int. Cl.[3] ..... B07B 13/10

[52] U.S. Cl. ..... 209/481; 209/485; 209/488; 209/504; 209/694

[58] Field of Search ..... 209/479-481, 209/485, 488, 504, 314, 691, 694

[56] References Cited

U.S. PATENT DOCUMENTS

| | | | |
|---|---|---|---|
| 1,415,610 | 5/1922 | Palmer et al. | 209/694 |
| 3,044,621 | 7/1962 | Pearlman et al. | 209/694 |
| 3,232,431 | 2/1966 | Musschoot et al. | 209/314 X |
| 3,241,674 | 3/1966 | Weber | 209/504 X |
| 3,464,550 | 9/1969 | Bieler et al. | 209/694 |

*Primary Examiner*—William A. Cuchlinski, Jr.
*Attorney, Agent, or Firm*—Pascal & Associates

[57] ABSTRACT

An apparatus and method for separating waste material contained in a heap in at least one separating zone, the heap largely comprising particles of the same shape, size and density, from which the waste particles differ. It also relates to apparatus for performing the method. The heap is fed onto an inclined conveying surface where it is vibrated and the waste particles are removed upwards and the remaining particles downwards, the vibrations being initiated at an angle to the horizontal which is larger than the inclined position of the conveying surface.

13 Claims, 7 Drawing Figures

1
$S_1$
$\alpha_1$
2'
3'
9
4'
$\alpha_2$
K
$S_2$
6
7
5

2'
4'
3'
4'
2'
10'
10'
6
7
5

APPARATUS FOR SEPARATING WASTE MATERIAL CONTAINED IN A HEAP

This invention relates to a method for separating waste material contained in a heap in at least one separating zone, the heap largely comprising particles of the same shape, size and density, from which the waste particles differ. It also relates to apparatus for performing the method.

For example in a plastics factory a granular material is often produced as an intermediate product prior to processing to the end product. The plastic granulate particles have a specific size and shape. The uniformity of the granulate makes is possible to accurately meter the quantity to be fed to the machine which produces the end product. The precise metering is very important for reducing the amount of waste. Therefore the granulate manufacturer attempts to produce granular material which is absolutely uniform with regard to shape and size. However, in granulate manufacture it is in many cases unavoidable, for various reasons, that defective granular material is obtained, even if it is only in small quantities. This defective granular material can be of various types. Thus, e.g. a number of individual granulate particles may have stuck together (three or four particle groups, etc.), or particles can be obtained which are much longer than a desired granulate particle (overlengths) or granulate strands can be obtained in which the individual granulate particles are partly but not completely cut (bead chains).

Thus, these effective granulate particles can have very varied shapes (straight particles with many times the length of normal particles, twisted partly cut strands, etc.). All these defective granulates make accurate metering impossible, in the manner indicated hereinbefore and therefore lead to a more or less large waste quantity for final processing.

It is not only in the production of plastics granulates that the problem of prevention or subsequent separation of waste particles occurs and it is in fact encountered wherever a heap of uniformly shaped and sized particles or material is to be produced by a corresponding manufacturing process, e.g. moulding, compacting or cutting, whereby they can also be an end product and not an intermediate product as is the case with plastics (e.g. activated carbon pressed articles, granulated foodstuffs, etc.).

Since, as stated hereinbefore, defective granulate particles cannot generally be prevented in the various granulating processes there is a hitherto not or only partly solved problem of optimum separation of these waste particles which, if not separated, signify a reduction in the value of the finished or intermediate product.

Hitherto attempts have been made to separate the waste particles by screening processes of various types. However, this method has failed because by means of a sieve netting or a perforated plate the straight shaped particles corresponding to the desired cross-section, but having many times the desired length, are placed on end by the screening movement and then drop vertically through the sieve opening, i.e. are not held back. This is particularly the case if the screen movement and mesh width are selected in such a way that a clogging of the sieve opening is reliably avoided by near-mesh material (two, three or more particles joined together). A less intense screening movement, i.e. a lower amplitude of vibration admittedly prevents the long, straight shaped particles from being vertically positioned, but the screen surface then becomes clogged within a short period of operation by near-mesh material or defective granulate. The partly cut, three-dimensionally curved granulate strands (bead chains) also hook themselves into the sieve openings, making it necessary to manually remove said defective granulate every so often. These problems also occur if oblong perforated plates or long mesh sieve nettings are used. The trouble-free separation of defective granular material from the heap is also not ensured by the use of step sieves (step perforated plates).

The problem is therefore to find a method which reliably and cost-effectively permits the separation of waste particles.

This problems is solved by the features claim 1. Advantageous embodiments thereof are defined in the dependent claims.

Various embodiments of the apparatus for performing the method are described hereinafter relative to the drawings, wherein show:

Figure 1:
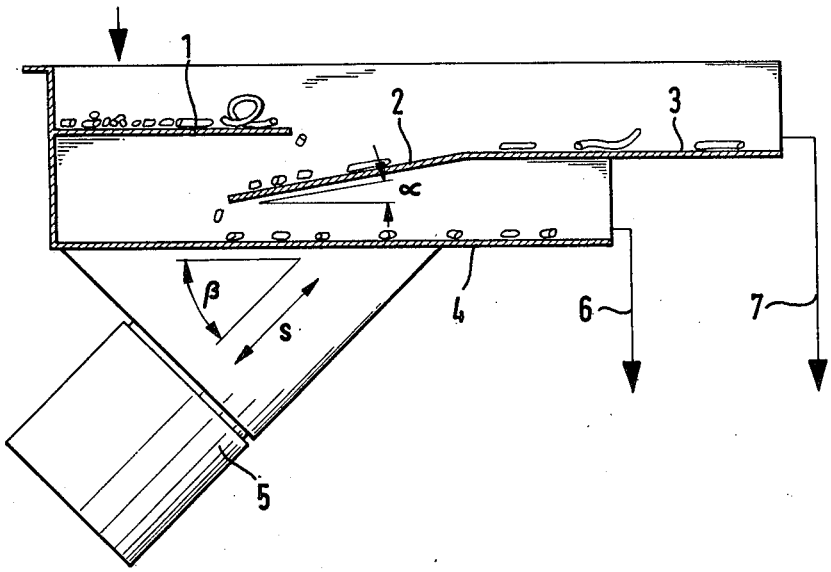
FIG. 1 is a section through a first embodiment of an apparatus.

By means of the method described hereinafter it is possible to achieve a trouble-free separation of waste particles, for example defective granulate, because there is no problem of clogging of sieve openings by defective granular material and also no hooking, e.g. of partly cut granulate strands. The basis for this separation method is the observation that fragments with several times the normal granulate length or several times the normal granulate size (fragments formed by two, three or more particles) under some conditions have a different feed behaviour than normal granular material when conveyed uphill, by means of vibration.

The feed granulate is metered onto a horizontally moving plate 1 and said granulate drops from the leading edge of plate 1 onto a conveying plate 2, which is inclined at an angle $\alpha$ to the horizontal. Both the horizontally moving plate 1 and the conveying plate 2 are arranged in a casing, to the bottom of which is flanged a vibrator 5. This vibrating motor performs vibrations or oscillations, whose direction is at an angle $\beta$ to the horizontal. This vibration amplitude is designated as s. The vibration direction or projecting angle $\beta$ is larger than the angle $\alpha$ under which the feed plate 2 is inclined to the horizontal.

The separation takes place of the product which is passed onto the feed plate 2 and specifically the waste particles are conveyed upwards and removed by means of a channel 3, whilst the particles having substantially the same shape, size and density roll downwards from the plate 2 and are removed by a channel 4. As a result the waste particles are removed via 7, whilst the normal granulate particles are moved outwards via 6.

The varying feed or conveying behaviour is particularly illustrated if a mixture of normal and defective granular material is conveyed upwards by means of vibration on feed plate 2 at an angle $\alpha$ of 5° to 15°, the projecting angle $\beta$ on the one hand and the vibration amplitude s and vibration frequency on the other can be adapted to the particular shape, size and density of the product granulate.

Another parameter which can be adapted to the nature of the product is the specific action on the separating or feed section. When applying a larger granulate material height a larger vibration amplitude and a different pitch angle are required for obtaining the same results.

A separation with an apparatus according to FIG. 1 under the above-described conditions with upward conveying at an angle $\alpha=10°$, a projecting angle $\beta=30°$ to the horizontal, a vibration amplitude s of approx. 1.1 mm and a frequency of 50 Hz shows that on feeding in a mixture of satisfactory and defective granulate the normal granulate is only partly upwardly conveyed, whilse most tends to roll backwards in accordance with the slope, i.e. counter to the feed direction. The defective granulate, i.e. fragments formed from three, four or more particles, and the bead chains and straight overlengths are conveyed upwards, i.e. in the feed direction, if the longitudinal axis thereof runs in the feed direction. Straight overlength fragments which are not aligned in the feed direction can also roll backwards. As a result of appropriate measures these fragments should be aligned longitudinally with respect to the feed direction, which can e.g. be achieved by dividing up the feed plates in a number of individual paths by means of separating plates 8 (of particularly FIG. 4).

The separating or classifying effect is dependent on a number of factors, e.g. the shape of the particles to be separated, as in the case of the previously described plastic granulate. However, in the case of identical partical size it is also possible to effect separation on the basis of the specific gravity in this way.

During the separation process the known physical laws of rolling and sliding friction are used and when separating materials of the same particle size, but different specific gravities, additionally the laws of inclined projection are used in conjunction with those of rolling and sliding friction.

Since when using only a rising feed section the separating effect can be incomplete, this process can be repeated by the series arrangement of a plurality of feed sections, which can in particular be arranged in cascade form.

Figure 2:
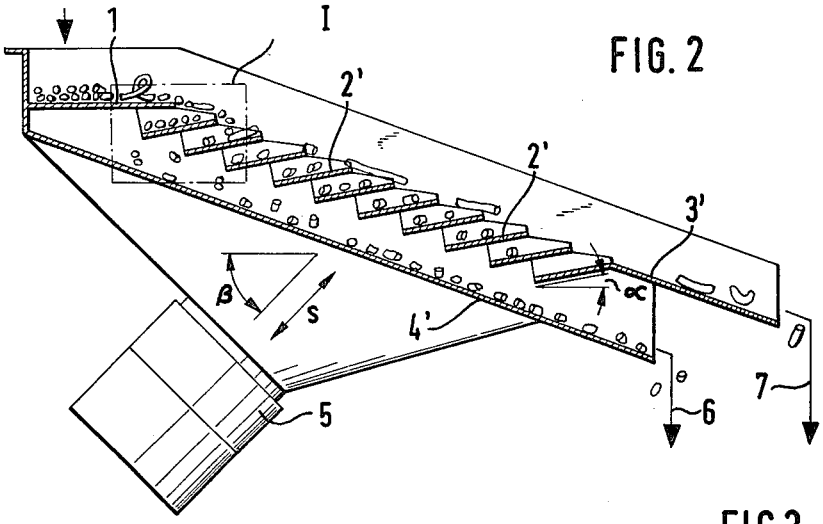
FIG. 2 is a section through a second embodiment.

In the embodiment of FIG. 2 a plurality of feed surfaces 2' are arranged in cascade form below the horizontal plate 1 and are inclined at an angle $\alpha$ to the horizontal. The waste particles are moved upwards on the feed surfaces 2' and finally pass onto the inclined channel 3' and are discharged at 7. The normal granulate particles roll downwards on feed surfaces 2' and pass into a channel 4', then being discharged at 6. Here again it is ensured that the projecting angle $\beta$ at which the vibrations are initiated by the vibrating motor 5 is greater than the angle $\alpha$ by which the feed surfaces 2' are inclined to the horizontal.

Figure 3:
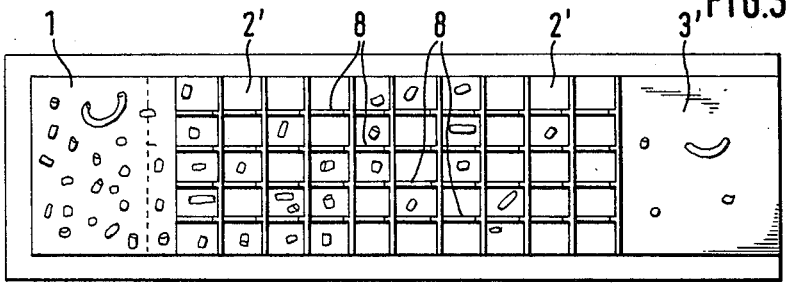
FIG. 3 is a plan view of the second embodiment.
Figure 4:
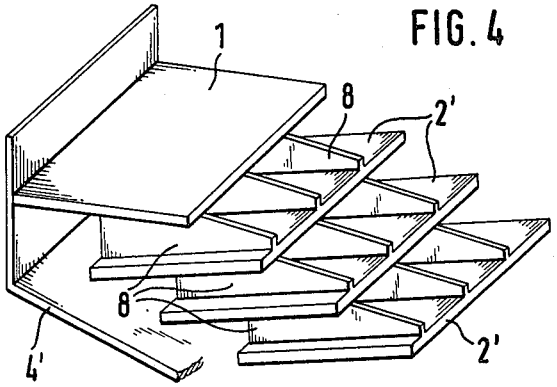
FIG. 4 is a perspective view of part of the second embodiment.

FIGS. 3 and 4 additionally show how the feed surfaces 2' are subdivided into individual paths by means of separating plates 8, which in this case by in the direction of the feed surfaces 2'.

It has also been found that the flatter the pitch angle $\alpha$ and the greater the number of cascades the better the separating action, particularly with respect to defective granulates, whose size and/or weight only differs slightly from those of desired granulates (twin particle fragments, straight overlengths having only double the desired length, etc.).

Figure 5:
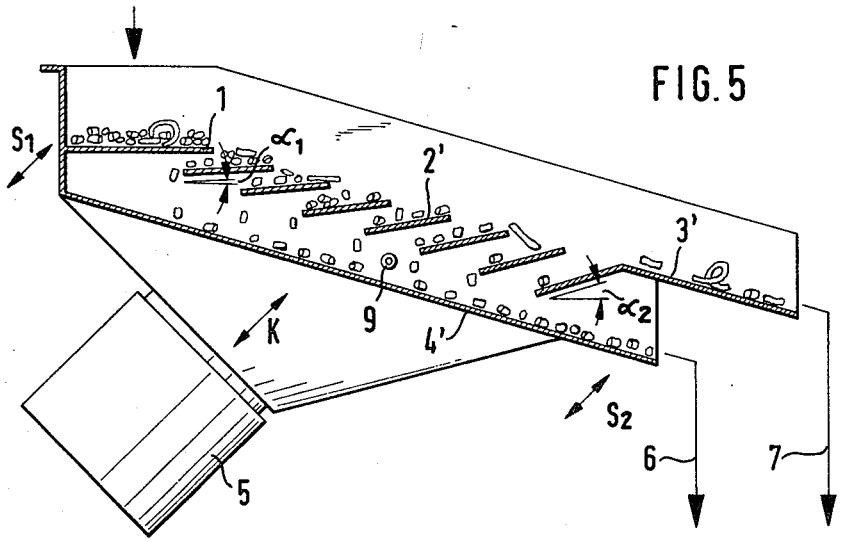
FIG. 5 is a section through a third embodiment.

In the embodiment of FIG. 5 the slope angle $\alpha$ under which the feed surfaces 2' are inclined to the horizontal increases from top to bottom. Thus, the upper feed surface 2' has a smaller inclination angle $\alpha_1$ than the lower feed surface having the inclination $\alpha_2$. This embodiment also ensures that the projecting angle $\beta$ is larger than the largest inclination angle $\alpha_2$.

This embodiment can also be constructed in such a way that the vibration amplitude $s_1$ in the upper zone is larger than the vibration amplitude $s_2$ in the lower zone.

In the case of the series connection of a plurality of separating stages or cascades, of FIG. 5, in which the loose material height constantly decreases up to the final cascade and the pitch angle $\alpha$ increases from cascade to cascade, the vibration amplitude s is preferably selected inversely proportional to the pitch angle $\alpha$. The latter is possible by simple technical means in that by correspondingly arranging the vibrator 5 or by displacing the direction in which the vibrating forces K act from the direction of the centre of gravity 9 various vibration amplitudes $s_1$ and $s_2$ can be produced on the inlet and outlet sides. The adjustment of the cascade angle $\alpha$ is generally taken into consideration during the design of the apparatus.

If an almost complete separation of the defective granular material is necessary this requirement can be met by repeating the same separating process two or more times. To bring this about the granular material from the first separating process and which still does not satisfy the quality requirements is returned one or more times to the same apparatus and undergoes the same separating process one or more times.

Figure 6:
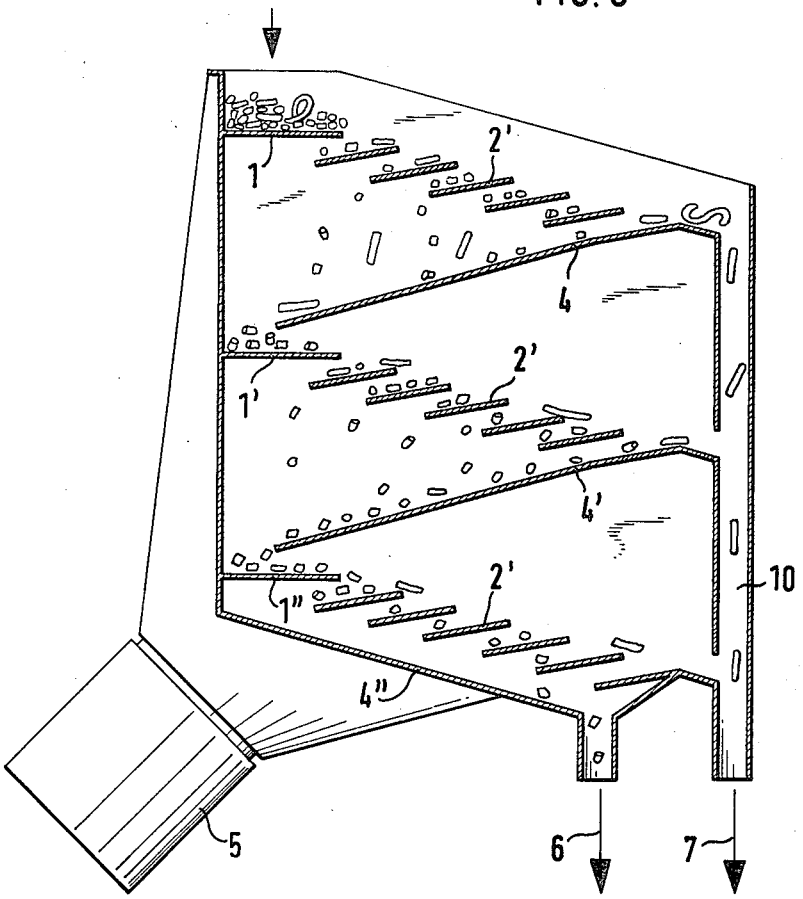
FIG. 6 is a section through a fourth embodiment.

In the embodiment of FIG. 6 the product firstly passes onto the horizontal plate 1, from where it then passes onto the cascade-like feed surfaces 2', where a partial separation takes place. At this cascade most of the waste material is discharged by chute 10. The normal granulate, which may still contain waste material, passes via channel 4 to the horizontal plate 1', from where the material is fed to the next cascade. Most of the still existing waste material is discharged via chute 10, whilst the normal granulate particles, which may still contain very small amounts of waste, pass via channel 4' to the horizontal plate 1' and from there to the next cascade. Any waste material still present is discharged by chute 10, whilst the normal granulate particles are discharged at 6 via channel 4''.

It is also possible to connect in parallel two or more cascade lines, so that a double or even greater throughput capacity is achieved in the same apparatus.

Figure 7:
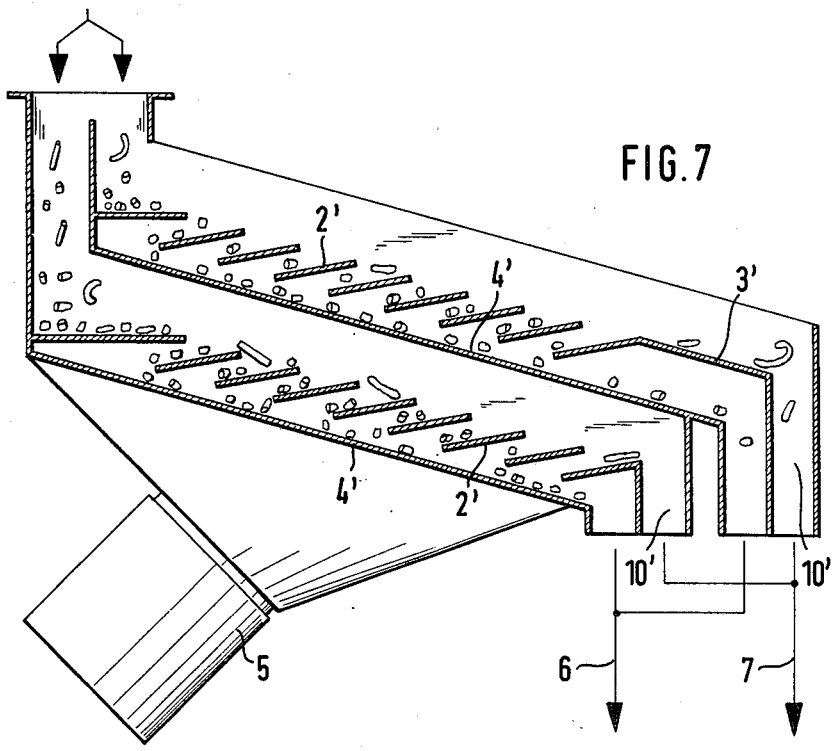
FIG. 7 is a section through a fifth embodiment.

FIG. 7 shows an embodiment in which two cascades are arranged parallel to one another. This parallel arrangement is vibrated by a common vibrating motor 5. It is naturally also possible to combine parallel and series connection of cascade lines.

In addition to the above-mentioned parameters such as frequency, projecting angle, etc. the arrangement of the cascades relative to one another and the length thereof are important for optimising the separating effect. Whilst the most favourable length is dependent on the size and shape of the granulate, the arrangement can fundamentally be such that greater overlengths are only subject to the feed process on the first cascade, whilst only sliding over the remaining cascades, so that said fragments do not further burden the actual separating process (of FIG. 2).

The above-described separating process or the constructional embodiments for performing the same illustrate the most important advantages of the invention. Thus, an apparatus operating according to the present method does not require a sieve lining which has a tendency to clogging by near-mesh material and in which three-dimensionally curved defective granulates can be hooked. It is easy to operate and ensures that on changing product or colour only limited work is required for cleaning the same.

By means of this separating process it is possible whilst using relatively limited expenditure and effort to subdivide a loose material on the basis of the particle shape, which can only be achieved to an unsatisfactory extent with a screening machine, i.e. for example the separation of straight overlengths.

What we claim is:

1. Apparatus for separation of waste material in a heap in at least one separating zone including a plurality of inclined conveying surfaces staggered in cascade-like manner with respect to one another, the heap largely comprising similar particles of substantially the same shape, size and density and from which only the waste particles differ, means for feeding the heap onto the inclined surfaces disposed adjacent the top of the separating zone, vibrator means for vibrating the inclined surfaces, the vibration direction thereof being at a larger angle to the horizontal than the inclinations of said surfaces, the leading edges of the cascade-like conveying surfaces forming a slope over which long and/or voluminous waste particules can slide without passing onto the conveying surfaces.

2. Apparatus as defined in claim 1, in which the inclined conveying surface is profiled in the conveying direction.

3. An apparatus as defined in claim 2 further including separating members adapted to profile the conveying surface in the conveying direction.

4. Apparatus as defined in claim 1, wherein a removal plate is disposed adjacent the conveying surface at the end of the separating zone for collecting the waste particles, and a further removal plate is disposed below the conveying surface for collecting said similar particles.

5. An apparatus as defined in claim 4, in which the particles collected by the further removal plate are supplied to at least one further separating zone.

6. Apparatus as defined in claim 5 in which at least two cascades are directed oppositely to one another.

7. Apparatus as defined in claim 5, in which at least two cascades are directed oppositely to one another.

8. An apparatus as defined in claim 1, 4 or 5 in which the inclination of the conveying surfaces to the horizontal increases from top to bottom of the separating zone.

9. Apparatus as defined in claim 8, wherein the amplitude of vibration is greater with the less inclined conveying surfaces than with the more inclined conveying surfaces.

10. Apparatus as defined in claim 1 or 4 in which at least two separate conveying sections are provided.

11. Apparatus as defined in claim 10 in which at least two parallel separate conveying sections are provided.

12. Apparatus as defined in claim 1 in which the conveying surface is roughened.

13. An apparatus as defined in claim 1 including means for adjusting the amount of material fed in per unit of time, the inclination of the conveying surfaces, and/or the angle, amplitude and/or frequency of the vibrations.

* * * * *